US005479520A

United States Patent [19]

Nieuwendijk et al.

[11] Patent Number: 5,479,520

[45] Date of Patent: Dec. 26, 1995

[54] LOUDSPEAKER SYSTEM

[75] Inventors: Joris A. M. Nieuwendijk; Johannes W. T. Bax; Martinus P. M. Van Den Thillart, all of Eindhoven, Netherlands

[73] Assignee: U.S. Philips Corporation, New York, N.Y.

[21] Appl. No.: 123,273

[22] Filed: Sep. 17, 1993

[30] Foreign Application Priority Data

Sep. 23, 1992 [EP] European Pat. Off. ..... 92202913

[51] Int. Cl.[6] ..... H04R 25/00

[52] U.S. Cl. ..... 381/154; 381/159; 181/160

[58] Field of Search ..... 381/154, 159, 381/156, 158, 152, 153, 160; 181/152, 199, 160, 185, 187, 189

[56] References Cited

U.S. PATENT DOCUMENTS

| | | | |
|---|---|---|---|
| 1,969,704 | 8/1934 | D'Alton | 181/160 |
| 2,193,399 | 3/1940 | Fisher | 181/160 |
| 2,670,053 | 2/1954 | Doms | 181/199 |
| 4,142,603 | 3/1979 | Johnson | 181/199 |
| 5,137,110 | 8/1992 | Bedard, Jr. et al. | 381/154 |

FOREIGN PATENT DOCUMENTS

| | | | |
|---|---|---|---|
| 0429121 | 5/1991 | European Pat. Off. . | |
| 2213551 | 8/1974 | France | G01K 11/08 |

*Primary Examiner*—Curtis Kuntz
*Assistant Examiner*—Huyen D. Le
*Attorney, Agent, or Firm*—Robert J. Kraus

[57] ABSTRACT

An enclosure (35) of a loudspeaker (37) is provided with a plurality of tubes (43) of different length via which the sound is emitted in order to achieve frequency spreading of resonance peaks in the SPL (sound pressure level) curve. The side walls (46, 47) of the tubes (43) have openings (63) via which the tubes are coupled to common Helmholtz resonators (59, 61) in order to suppress undesirable resonances in the tubes (43). By spreading the resonance peaks it is possible to use Helmholtz resonators of smaller dimensions than in the case that the sound would emanate via a single tube. This results in a loudspeaker system (33) with more compact and cheaper Helmholtz resonators (59, 61).

6 Claims, 4 Drawing Sheets

LOUDSPEAKER SYSTEM

BACKGROUND OF THE INVENTION

The invention relates to a loudspeaker system comprising an enclosure, a loudspeaker arrangement accommodated in the enclosure, a tube having one end connected to the enclosure, a volume bounded by the tube and communicating with a volume bounded by the enclosure, and a chamber connected to the tube and bounding a volume which communicates with the volume bounded by the tube.

A loudspeaker system of the type defined in the opening paragraph is known from EP 0,429,121 A1. The sound produced by the loudspeaker arrangement emanates from the open end of the long tube. An advantage of the use of a long tube is that the loudspeaker system becomes more sensitive, i.e. produces more acoustic output for the same electrical input, while the lowest resonant frequency hardly increases. With this known loudspeaker system it is possible to arrange the loudspeaker arrangement at a large distance from the exit aperture and to reduce the volume bounded by the housing while at the same time the tube length is increased, which yields greater freedom in the design of the loudspeaker system. This enables a stiff enclosure (cabinet) to be made with the result that cabinet resonances are minimal. The loudspeaker arrangement may comprise, for example, a cone loudspeaker or a plurality of cascaded loudspeakers. The chamber functions as a Helmholtz resonator and, when tuned correctly, suppresses the occurrence of standing waves (resonances) in the tube, which are a source of distortion of the output signal of the loudspeaker system. A correct tuning means inter alia that the volume of the chamber (Helmholtz resonator) should be related to the size of the loudspeaker arrangement. When a 5¼" loudspeaker is used the volume of the chamber should be approximately 1 liter whereas for an 8" loudspeaker the volume of the chamber should already be approximately 4 liters. The acoustic damper (Helmholtz resonator) is bulky, particularly in the last-mentioned case, and forms a comparatively expensive part.

SUMMARY OF THE INVENTION

It is an object of the invention to provide a loudspeaker system of the type defined in the opening paragraph, whose acoustic damper is of a more compact construction than that of the prior-art loudspeaker system. To this end the loudspeaker system in accordance with the invention is characterised in that the loudspeaker system comprises at least one further tube having another length than said tube and having one end connected to the enclosure, a volume bounded by the further tube communicating with the volume bounded by the enclosure, and the further tube is connected to the chamber, the volume bounded by the further tube communicating with the volume bounded by the chamber. By the use of tubes of different lengths it is achieved that the undesirable first resonance peak in the SPL (sound pressure level) curve is spread in frequency into a number of adjacent smaller peaks of reduced level. The resonances in the tubes can then be suppressed by means of a less powerful damper, i.e. a more compact Helmholtz resonator (smaller chamber), which is consequently also cheaper. In comparison with the prior-art loudspeaker system the present loudspeaker system rather has the nature of a pure acoustic transmission line and provides a wider range of constructional possibilities. It is now possible to arrange a plurality of narrow tubes in a row against one another, enabling a very flat construction to be obtained.

An embodiment of the loudspeaker system in accordance with the invention is characterised in that the tubes are connected to a further chamber and the volumes bounded by the tubes communicate with a further volume bounded by the further chamber. As a result of this, the Helmholtz resonator formed by one of the chambers can be tuned to suppress the first resonance peak and the Helmholtz resonator formed by the other chamber can be tuned to reduce the other peaks. The chambers can then be arranged at opposite sides of the tubes, which yields a symmetrical construction in which the tubes are loaded more favourably than in the case of a chamber arranged at only one side of the tubes.

A further embodiment of the loudspeaker system in accordance with the invention is characterised in that the loudspeaker arrangement divides the volume bounded by the enclosure into a first and a second subvolume, and the first subvolume communicates with volumes which are bounded by a first group of tubes and which communicate with a volume bounded by a first chamber, and the second subvolume communicates with volumes which are bounded by a second group of tubes and which communicate with a volume bounded by a second chamber. This enables the invention to be implemented as a sixth-order band-pass box. By arranging the two groups of tubes in two mutually parallel rows a free space is obtained between the groups, enabling a loudspeaker cabinet with high and mid frequency loudspeakers to be arranged between the tubes. The sound-emanating surfaces are then situated close to one another, which is favourable for the reproduction of sound.

Yet a further embodiment of the loudspeaker system in accordance with the invention is characterised in that the tubes comprise two parallel walls which are interconnected by two side walls and at least one partition wall, and one wall of the chamber is formed by one of the two parallel walls of the tubes, openings in the wall of the chamber and in the side walls of the tubes being coincident. This results in a stiff and compact construction of the loudspeaker system.

The undesirable resonance peaks are spread further as the number of tubes is increased. However, more tubes also means a more expensive construction. It has been found that an optimum compromise between construction costs and spreading of the resonance peaks is obtained with five tubes. With a smaller number of tubes the effect of spreading decreases considerably to such an extent that for hi-fi use the quality becomes doubtful. More than five tubes improves the spreading of the resonance peaks but the costs then increase comparatively strongly so that this remains of interest for high-end applications only. For the afore-mentioned reasons a further embodiment of the loudspeaker system in accordance with the invention is characterised in that at least five tubes of different lengths are secured to the enclosure, which tubes are acoustically coupled to the volume in the enclosure and to the volume in the chamber.

A preferred embodiment of the loudspeaker system in accordance with the invention is characterised in that the tubes each have a pathlength over which sound waves propagate in the tube, the pathlength difference between the shortest and the longest tube being 30 to 40% of the pathlength of the longest tube. If said pathlength difference is smaller than said preferred range the resonance peaks will be situated too close to each other, so that they will rather behave as a single resonance peak, requiring again a large and expensive Helmholtz resonator for the suppression of this resonance peak. If said pathlength difference is larger than said preferred range only the shortest tube will be active because it has the smallest acoustic mass, so that again a single resonance peak will occur which again requires a large and expensive Helmholtz resonator for its suppression.

These and other aspects will become apparent from and will be will be elucidated on the basis of the embodiments described hereinafter.

BRIEF DESCRIPTION OF THE DRAWING

The invention will now be described in more detail, by way of example, with reference to the drawings. In the drawings

DESCRIPTION OF THE PREFERRED EMBODIMENTS

Figure 1:
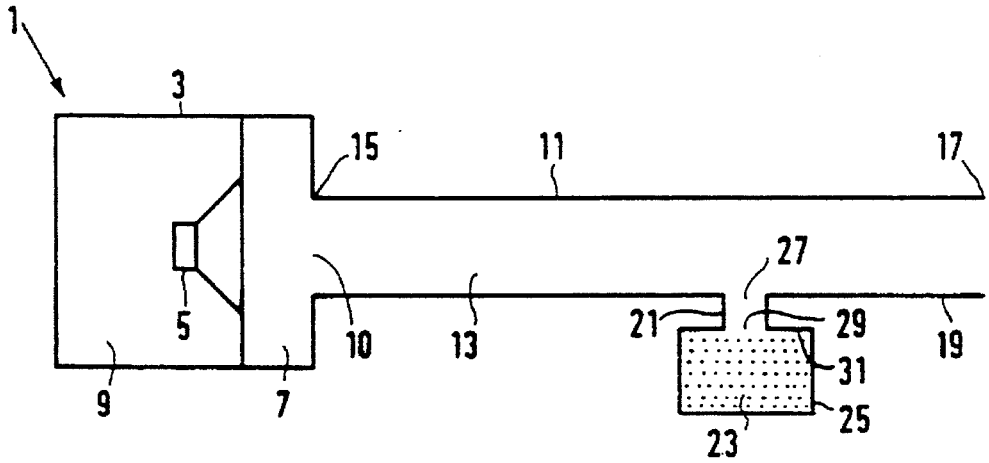
FIG. 1 PRIOR ART
FIG. 1 shows the prior-art loudspeaker system.

FIG. 1 shows the prior-art loudspeaker system 1. This loudspeaker system comprises an enclosure 3 which accommodates a loudspeaker arrangement comprising a cone loudspeaker 5, which divides the enclosure volume into two subvolumes 7, 9. In this way a so-called band-pass box is obtained, which is often used as a subwoofer for the reproduction of sound of low frequencies (for example 40–200 Hz). One of the subvolumes 7 communicates with a volume 13 bounded by a tube 11 via an aperture 10 in the enclosure. The tube 11 is secured to the enclosure 3 at one end 15, the other end 17 being free. An advantage of the use of such a tube 11 having a great length is that it is possible to reduce the two subvolumes 7, 9 and at the same time increase the length of the tube. As a result of this it is possible to create enclosures of deviating shapes, for example tall and slender. A disadvantage of a tube of great length used as a port is that in the tube intensive acoustic resonances occur with frequencies close to the operating range. These resonances can be suppressed by means of an acoustic damper. For this purpose a short pipe 21 is secured to a side wall 19 of the tube 11 and puts the volume 13 in the tube into communication with a bounded volume 23 in a chamber 25, secured to the pipe 21, via an opening 27 in the side wall 19 of the tube 11 and an opening 29 in a wall 31 of the chamber 25. This chamber forms a Helmholtz resonator operating as an acoustic damper, for example in the frequency range of 200–700 Hz. The volume 23 in the chamber 25 has been filled with an acoustic damping material. In a loudspeaker system with a long tube the tube functions rather as an acoustic transmission duct than as a bass-reflex port. In order to suppress the resonances in such a long tube the construction of the Helmholtz resonator should meet a number of requirements. This is described in EP 0,429,121 A1 (herewith incorporated by reference). The volume of the chamber 25 should be related to the size of the loudspeaker so that, when used conjunction with a large loudspeaker, the Helmholtz resonator is bulky and comparatively expensive.

Figure 2A:
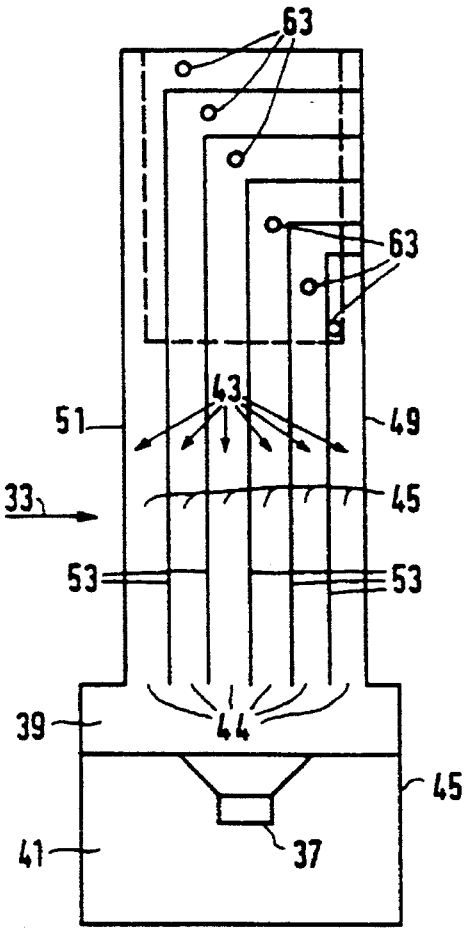
FIG. 2*a* is a sectional view of a first embodiment of the loudspeaker system in accordance with the invention.
Figure 2B:
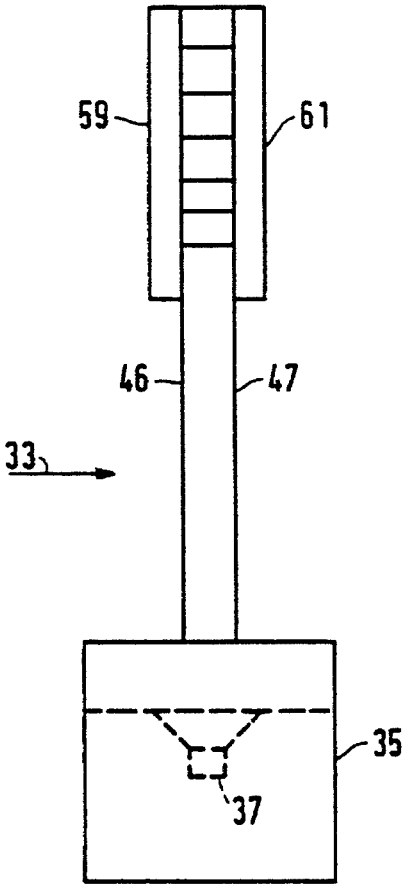
FIG. 2*b* is a front view of the embodiment shown in FIG. 2*a*.
Figure 3:
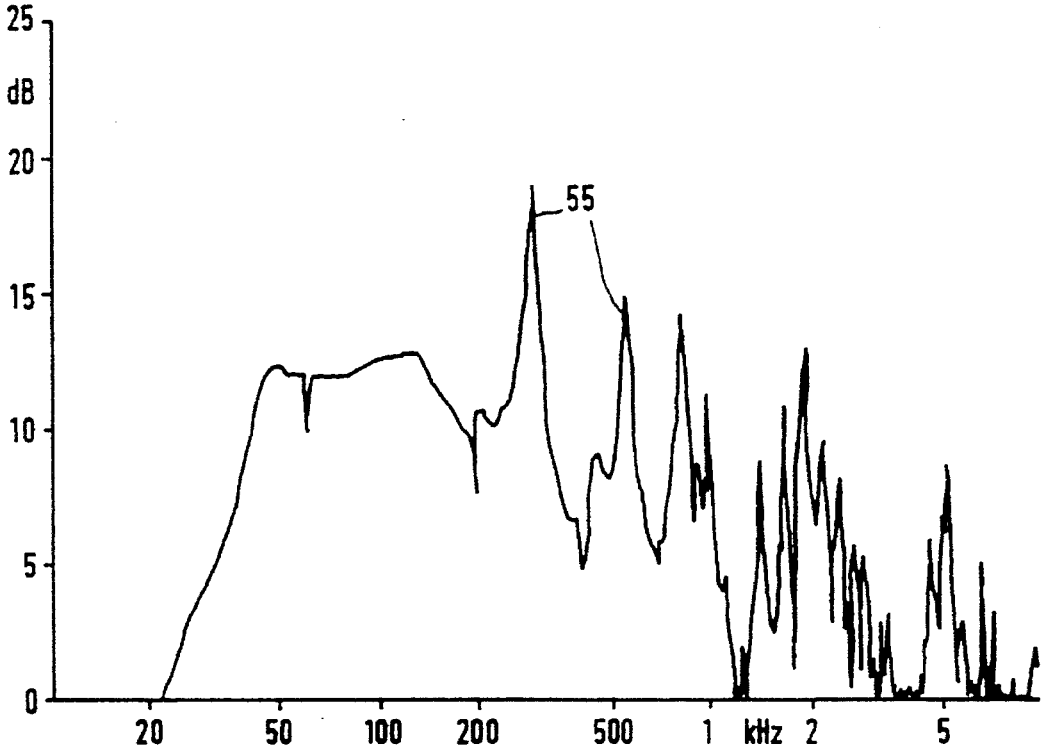
FIG. 3 shows the SPL (sound pressure level) curve of a loudspeaker system comprising tubes of equal lengths.
Figure 4:
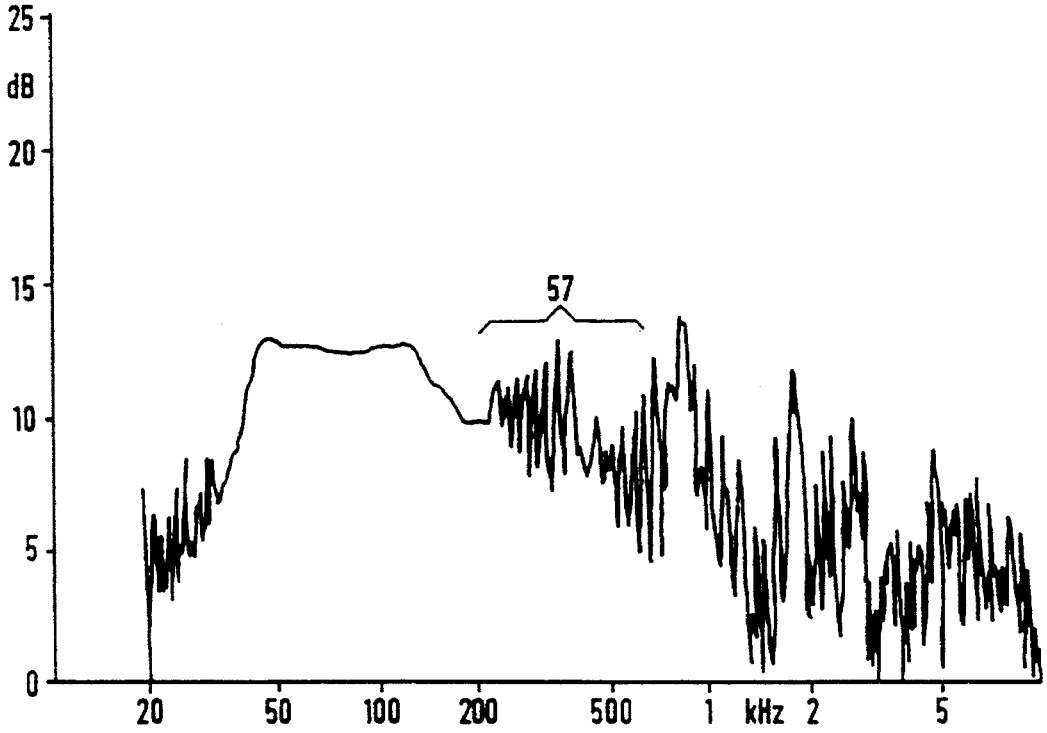
FIG. 4 shows the SPL curve of a loudspeaker system comprising tubes of different lengths.

FIGS. 2*a* and 2*b* show a first embodiment of the loudspeaker system in accordance with the invention. FIG. 2*a* is a sectional view and FIG. 2*b* is a front view of the loudspeaker system. The loudspeaker system 33 comprises an enclosure 35, which accommodates a loudspeaker arrangement comprising a cone loudspeaker 37 and dividing the volume in the enclosure 35 into a first subvolume 39 and a second subvolume 41. One of the subvolumes 39, 41 communicates with the surrounding via openings 44 in the enclosure 35. Such an enclosure with a loudspeaker arrangement forms a fourth-order band-pass box. Tubes 43 each have one end secured to the housing 35 so that the first subvolume 39 communicates with the internal volumes 45 of the tubes 43 via the openings 44 in the enclosure 35. The other ends of the tubes 43 are free. The tubes 43 are formed by two parallel walls 46, 47 interconnected by two side walls 49, 51 and five partition walls 53. This construction of the tubes 43 is very rigid, enabling very cheap materials to be used, such as for example polycarbonate or polypropylene. The side wall 51 and the partition walls 35 are L-shaped, so that the tubes 43 comprise two mutually perpendicular parts. As a result of this, the tubes 43 have different pathlengths so that undesirable resonant peaks in the SPL (sound pressure level) curve are spread into a number of adjacent smaller peaks of reduced level. The pathlength difference between the shortest and the longest tube is preferably 30 to 40% of the longest tube. FIG. 3 shows the SPL curve corresponding to a loudspeaker system as shown in FIG. 2 but comprising eight tubes of equal lengths and without the Helmholtz resonator. The Figure clearly shows the first and second resonance peaks 55. FIG. 4 shows the SPL curve corresponding to a loudspeaker system as shown in FIG. 2 but now comprising eight tubes of different lengths and again without the Helmholtz resonators. The tubes have a cross-section of 17×17 $mm^2$ and the length of the tubes varies in steps of 4 cm from approximately 46 cm to approximately 74 cm. The resonance peaks 55 have been resolved into a plurality of smaller peaks 57. Acoustic filtering in the range between, for example, 200 and 700 Hz is now possible with a more compact and, consequently, cheaper Helmholtz resonator. A chamber 59, 61 is arranged at opposite sides of the tubes. One wall of each chamber is formed by a wall 46, 47 of the tubes 43. The walls 46, 47 have openings 63 by which the volumes in the tubes 43 communicate with volumes bounded by the chambers 59, 61. These chambers 59, 61 form Helmholtz resonators operating as acoustic dampers. The Helmholtz resonator formed by one of the chambers 59 can be tuned to suppress the first resonance peak whereas the Helmholtz resonator formed by the other chamber 61 can be tuned to reduce the other resonance peaks. The two chambers 59, 61 can also be tuned to suppress the first resonance peak. The volumes in the chambers have been filled with an acoustic damping material, for example textile fibres, glass fibres or a plastics foam. This method of arranging tubes in the enclosure of a loudspeaker system is also possible with a series vented band-pass box. A characteristic feature of a series vented band-pass box is that the two subvolumes communicate with one another via an opening in the partition between the subvolumes and that one of the subvolumes communicates with the exterior via an opening in the wall of the enclosure.

Figure 5A:
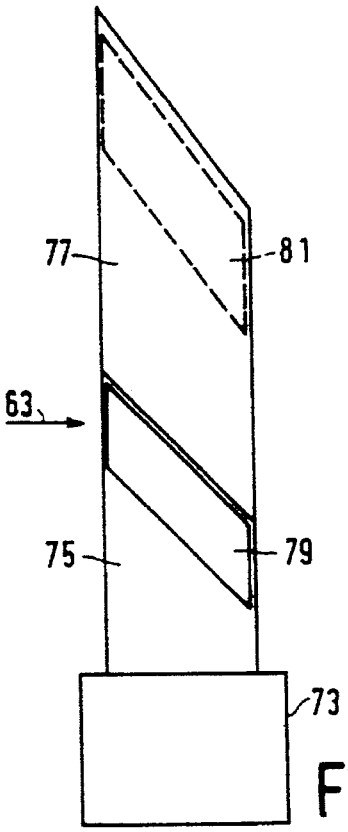
FIG. 5*a* is a side view of a second embodiment of the loudspeaker system.
Figure 5B:
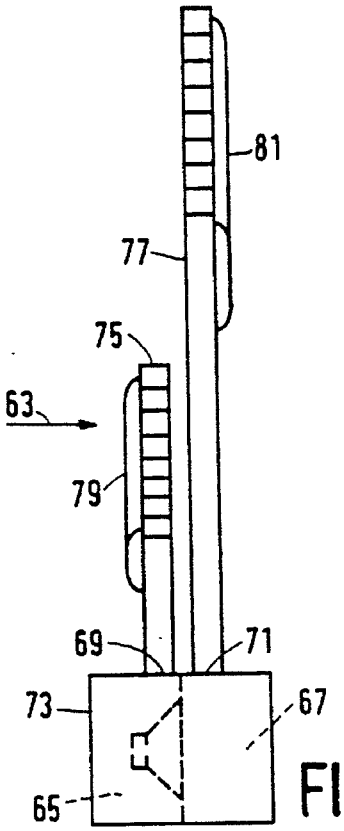
FIG. 5*b* is a front view of the embodiment shown in FIG. 5*a*.

FIGS. 5*a* and 5*b* show a second embodiment of the loudspeaker system in accordance with the invention. This loudspeaker system 63 comprises a sixth-order band-pass box. A characteristic feature of a sixth-order band-pass box is that the two subvolumes 65, 67 communicate with the exterior via openings 69, 71 in the housing 73. Each subvolume communicates with the exterior via a tube row 75, 77. The internal volumes of the tubes belonging to a tube row 75, 77 communicate with the internal volume of the chamber 79, 81 of a Helmholtz resonator via openings in the side walls of the tubes.

Figure 6A:
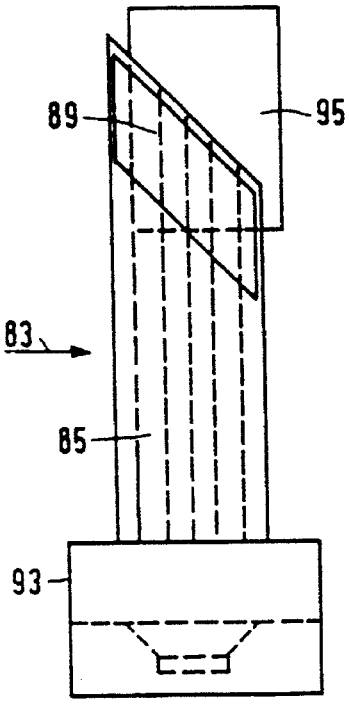
FIG. 6*a* is a side view of a third embodiment of the loudspeaker system.
Figure 6B:
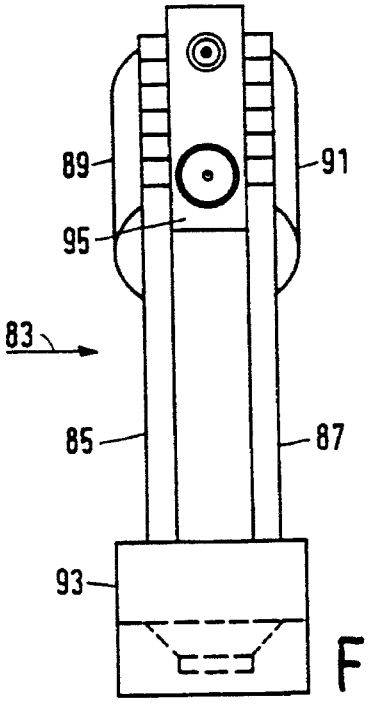
FIG. 6*b* is a front view of the embodiment shown in FIG. 6*a*.

FIGS. 6*a* and 6*b* show a third embodiment of the loudspeaker system in accordance with the invention. This loudspeaker system 83 comprises two identical rows 85, 87 of tubes, each provided with a Helmholtz resonator 89, 91 and secured to the enclosure 93. A further loudspeaker box 95 comprising loudspeakers for mid-range and treble reproduction is arranged between the two rows 85, 87.

Figure 7A:
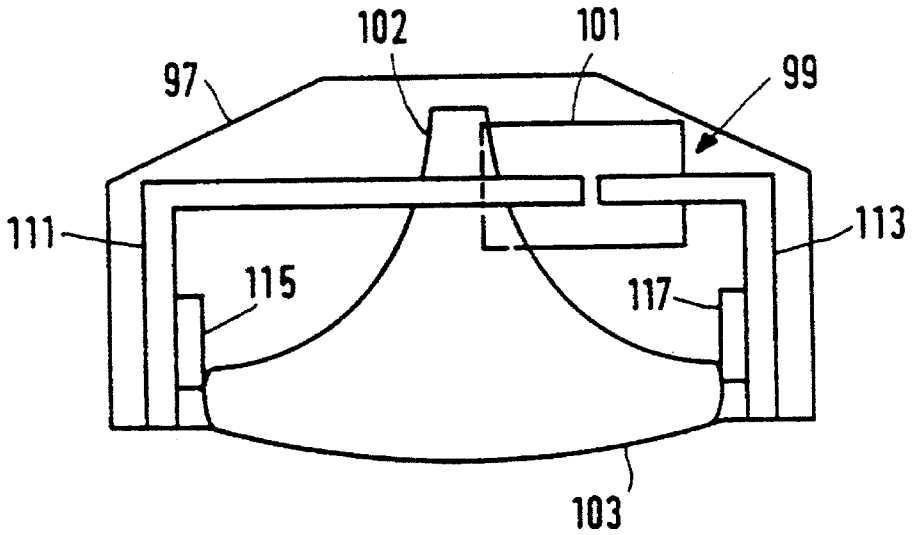
FIG. 7*a* is a sectional view of a television set comprising a fourth embodiment of the loudspeaker system.
Figure 7B:
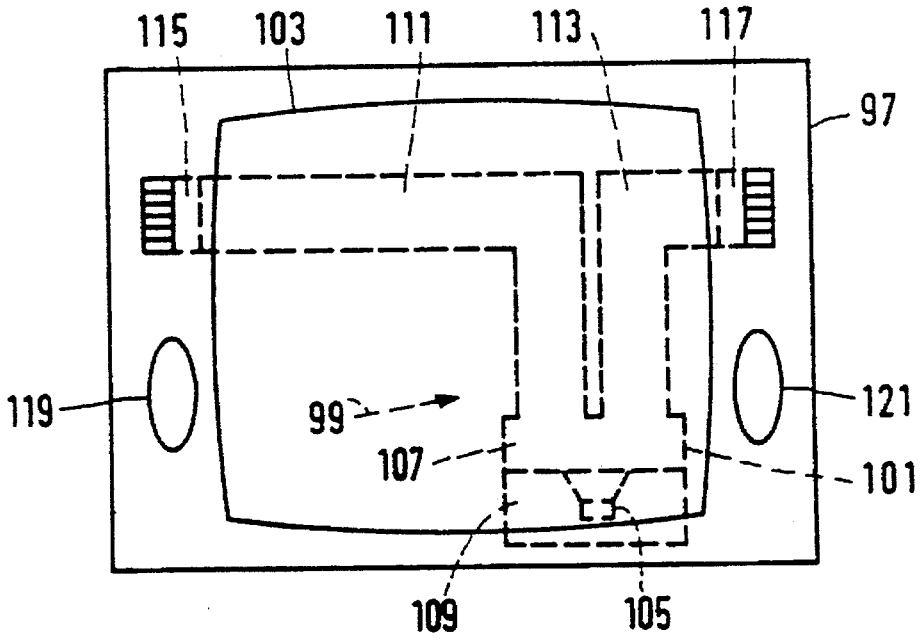
FIG. 7*b* is a front view of the television set shown in FIG. 7*a*.

FIGS. 7*a* and 7*b* show a television set 97 comprising a fourth embodiment of the loudspeaker system 99 in accordance with the invention. The enclosure 101 is situated to the right of the neck 102 of the picture tube 103. Again a loudspeaker 105 divides the enclosure 101 into two parts 107, 109. Two rows 111, 113 of tubes are secured to one of the parts. Since the tubes are right-angled the tubes have different pathlengths. Owing to the asymmetrical arrangement the tubes in one of the rows have other pathlengths than the tubes in the other row. This makes it possible to obtain a system of tubes all having different pathlengths. Near the free ends of the tubes chambers 115, 117 are arranged to provide the acoustic damping. The television set 97 further comprises two further loudspeakers 119, 121 for mid-range and treble reproduction.

Although the invention has been described with reference to the drawings this does not imply that the invention is limited to the embodiments shown in the drawings. The invention likewise relates to all embodiments which deviate from those shown in the drawings within the scope defined by the claims. For example, the tubes need not have equal cross-sectional dimensions. The cross-sectional dimensions may be selected in such a manner that they are inversely proportional to the pathlengths of the tubes in order to achieve that the acoustic masses in the tubes are substantially equal. Preferably, the loudspeaker system in accordance with the invention comprises five or more tubes. However, this is not necessary since even a smaller number of tubes, i.e. at least two, yields advantages in comparison with a loudspeaker system comprising only one tube.

We claim:

1. A loudspeaker system comprising an enclosure, a loudspeaker arrangement accommodated in the enclosure, a first tube having one end connected to the enclosure, a first volume bounded by the first tube and communicating with a volume bounded by the enclosure, and a first acoustic damping chamber connected to the first tube and bounding a volume which communicates with the first volume bounded by the first tube, characterized in that the loudspeaker system comprises at least a second tube having a different length than said first tube and having one end connected to the enclosure, a second volume bounded by the second tube communicating with the volume bounded by the enclosure, and the second tube is connected to the first acoustic damping chamber, the volume bounded by the second tube also communicating with the volume bounded by the first acoustic damping chamber.

2. A loudspeaker system as claimed in claim 1, characterized in that the first and second tubes are connected to a second acoustic damping chamber and the volumes bounded by the first and second tubes communicate with a volume bounded by the second acoustic damping chamber.

3. A loudspeaker system as claimed in claim 1 or 2, characterized in that the loudspeaker arrangement divides the volume bounded by the enclosure into a first and a second subvolume, and the first subvolume communicates with volumes which are bounded by a first group of tubes and which communicate with a volume bounded by a first acoustic damping chamber, and the second subvolume communicates with volumes which are bounded by a second group of tubes and which communicate with a volume bounded by a second acoustic damping chamber.

4. A loudspeaker system as claimed in claim 1 or 2, characterized in that the first and second tubes comprise two parallel walls which are interconnected by two side walls and a partition wall, and one wall of the first acoustic damping chamber is formed by one of the two parallel walls, openings in said one wall of the chamber and in the side walls of the tubes being coincident.

5. A loudspeaker system as claimed in claim 1 or 2, characterized in that at least five tubes of different lengths are secured to the enclosure, which tubes are acoustically coupled to the volume in the enclosure and to at least the volume in the first acoustic damping chamber.

6. A loudspeaker system as claimed in claim 1 or 2, characterized in that each of the tubes has a pathlength over which sound waves propagate in the tube, the pathlength difference between the shortest and the longest tube being 30 to 40% of the pathlength of the longest tube.

* * * * *